US007870618B2

(12) United States Patent
Pilon et al.

(10) Patent No.: US 7,870,618 B2
(45) Date of Patent: Jan. 18, 2011

(54) ADJUSTMENT MECHANISM FOR A HELMET

(75) Inventors: Christian Pilon, Montreal (CA); Philippe Martin, Chambly (CA); Ryan Crelinsten, Montreal (CA); Sébastien Morin, Ste-Julie (CA)

(73) Assignee: Sport Maska Inc., Montreal, Quebec (CA)

( * ) Notice: Subject to any disclaimer, the term of this patent is extended or adjusted under 35 U.S.C. 154(b) by 1133 days.

(21) Appl. No.: 11/529,358

(22) Filed: Sep. 29, 2006

(65) Prior Publication Data

US 2007/0079429 A1 Apr. 12, 2007

Related U.S. Application Data

(60) Provisional application No. 60/721,989, filed on Sep. 30, 2005.

(51) Int. Cl.
*A42B 1/22* (2006.01)
*A42B 1/06* (2006.01)

(52) U.S. Cl. ..... 2/417; 2/418; 2/410

(58) Field of Classification Search ..... 2/410, 2/425, 417, 418, 420; D2/870, 878; D29/102; 24/274 P, 285, 24, 59, 311, 327, 170, 191, 24/495, 498, 544, 163 R, 591.1, DIG. 43, 24/DIG. 47

See application file for complete search history.

(56) References Cited

U.S. PATENT DOCUMENTS

| | | | |
|---|---|---|---|
| 3,665,514 | A | 5/1972 | Durand |
| 3,882,547 | A | 5/1975 | Morgan |
| 4,404,690 | A | 9/1983 | Farquharson |
| 4,477,929 | A | 10/1984 | Mattson |
| 4,539,715 | A | 9/1985 | Clement |
| 5,956,776 | A | 9/1999 | Chartrand |
| 6,108,824 | A | 8/2000 | Fournier et al. |
| 6,154,889 | A | 12/2000 | Moore, III et al. |
| 6,159,324 | A | 12/2000 | Watters et al. |
| 6,317,896 | B1 | 11/2001 | Timms et al. |
| 6,324,700 | B1 | 12/2001 | McDougall |
| 6,341,382 | B1 | 1/2002 | Ryvin et al. |
| 6,349,416 | B1 | 2/2002 | Lampe et al. |
| 6,385,780 | B1 | 5/2002 | Racine |
| 6,418,564 | B1 | 7/2002 | Sheridan |
| 6,425,142 | B2 | 7/2002 | Sasaki et al. |
| 6,647,556 | B2 | 11/2003 | Grepper et al. |
| 6,751,808 | B2 | 6/2004 | Puchalski |
| 6,760,927 | B2 | 7/2004 | Guay |
| 6,865,752 | B2 | 3/2005 | Udelhofen et al. |
| 6,952,839 | B2 | 10/2005 | Long |
| 6,966,075 | B2 | 11/2005 | Racine |

(Continued)

*Primary Examiner*—Gary L Welch
*Assistant Examiner*—Amber R Anderson
(74) *Attorney, Agent, or Firm*—Ogilvy Renault LLP

(57) ABSTRACT

A helmet having a helmet shell including cooperating first and second sections in slidable engagement with one another, at least one locking assembly inter-connecting the first and second sections, the locking assembly including a pivoting member pivotable between a locked position and an unlocked position, the pivoting member in the locked position pressing the shell sections against one another such as to prevent a relative sliding motion therebetween, the pivoting member in the unlocked position allowing the relative sliding motion, and at least one engagement member connected to the first shell section and removably engaging the pivoting member in the locked position to prevent accidental movement of the pivoting member toward the unlocked position.

19 Claims, 7 Drawing Sheets

U.S. PATENT DOCUMENTS

| | | | | |
|---|---|---|---|---|
| 6,968,575 | B2 | 11/2005 | Durocher | |
| 6,981,284 | B2 | 1/2006 | Durocher | |
| 6,996,856 | B2 | 2/2006 | Puchalski | |
| 7,000,262 | B2 | 2/2006 | Bielefeld | |
| 7,076,811 | B2 | 7/2006 | Puchalski | |
| 2004/0172739 | A1* | 9/2004 | Racine | 2/417 |
| 2005/0262619 | A1 | 12/2005 | Musal et al. | |
| 2007/0266482 | A1* | 11/2007 | Alexander et al. | 2/418 |

* cited by examiner

ADJUSTMENT MECHANISM FOR A HELMET

CROSS-REFERENCE TO RELATED APPLICATION

This application claims priority on U.S. provisional application No. 60/721,989 filed Sep. 30, 2005, which is incorporated herein by reference.

FIELD OF THE INVENTION

The present invention relates in general to helmets and, more particularly, to a mechanism for adjusting the size of a helmet.

BACKGROUND ART

Adjustable helmets have been know in the art for years, and used in different applications such as sports, firefighting, construction work, and the military. In particular, many of these adjustable helmets allow the wearer to adjust the helmet size to fit a particular head. For example, helmet adjustment mechanisms have consisted of a stud and notch or a headband with a rack and pinion adjustment mechanism.

Although these and other conventional adjustment mechanisms have worked well, they have failed in a number of areas. For instance, many prior art designs do not allow the helmet wearer to adjust the size of the helmet while wearing the helmet. Accordingly, the helmet wearer must remove the helmet, adjust the helmet, and retry the helmet size multiple times before a proper fit can be established.

Moreover many prior art adjustment mechanisms present a risk of being accidentally actuated which can leave the wearer susceptible to injury.

SUMMARY OF INVENTION

It is therefore an aim of the present invention to provide an improved helmet adjustment mechanism.

Therefore, in accordance with the present invention, there is provided a helmet comprising a helmet shell including cooperating first and second sections in slidable engagement with one another, at least one locking assembly interconnecting the first and second sections, the locking assembly including a pivoting member pivotable between a locked position and an unlocked position, the pivoting member in the locked position pressing the shell sections against one another such as to prevent a relative sliding motion therebetween, the pivoting member in the unlocked position allowing the relative sliding motion, and at least one engagement member connected to the first shell section and removably engaging the pivoting member in the locked position to prevent accidental movement of the pivoting member toward the unlocked position.

Also in accordance with the present invention, there is provided a sports helmet comprising a helmet shell including first and second cooperating sections, the second section being partially received inwardly of the first section, at least one locking assembly interconnecting the first and second sections in slidable engagement with one another and including a pivoting member adjacent an outer surface of the first section, the pivoting member being pivotable between an unlocked position and a locked position about a pivot extending through the first and second sections, the locking assembly with the pivoting member in the unlocked position allowing a relative sliding motion between the first and second sections, and in the locked position pressing the first and second sections against one another such as to prevent the sliding motion, and an engagement member extending from the first section and releasably retaining the pivoting member in the locked position.

Further in accordance with the present invention, there is provided a sports helmet comprising a first helmet shell section having at least one first hole defined therein and at least one ramping member extending from the first section around the first hole, a second helmet shell section cooperating with the first section to define a helmet shell, the second section having a portion located inwardly of the first section and having a slot defined therein in alignment with the first hole, a spring plate located inwardly of the portion of the second helmet shell, a pivot extending from the spring plate and passing through the slot and the first hole, and a pivoting member adjacent an outer surface of the first section and having a second hole defined therethrough, the pivot being retained in the second hole such that the pivoting member is pivotable about the pivot, the pivoting member including at least one ramping member extending toward the first section around the second hole and complementary to the ramping member of the first shell section, the pivoting member pivoting from an unlocked position, where the ramping members engage one another to define a minimal distance between an outer surface of the pivoting member and an inner surface of the first section, and a locked position, where the ramping members engage one another to define a maximal distance between the outer surface of the pivoting member and the inner surface of the first section, the minimal distance providing for a loose connection between the first and second shell sections allowing a relative sliding motion therebetween, and the maximal distance providing for a tight connection between the first and second sections preventing the relative sliding motion.

BRIEF DESCRIPTION OF THE DRAWINGS

Reference will now be made to the accompanying drawings, showing by way of illustration a particular embodiment of the present invention and in which.

DETAILED DESCRIPTION OF PARTICULAR EMBODIMENTS

Figure 1:
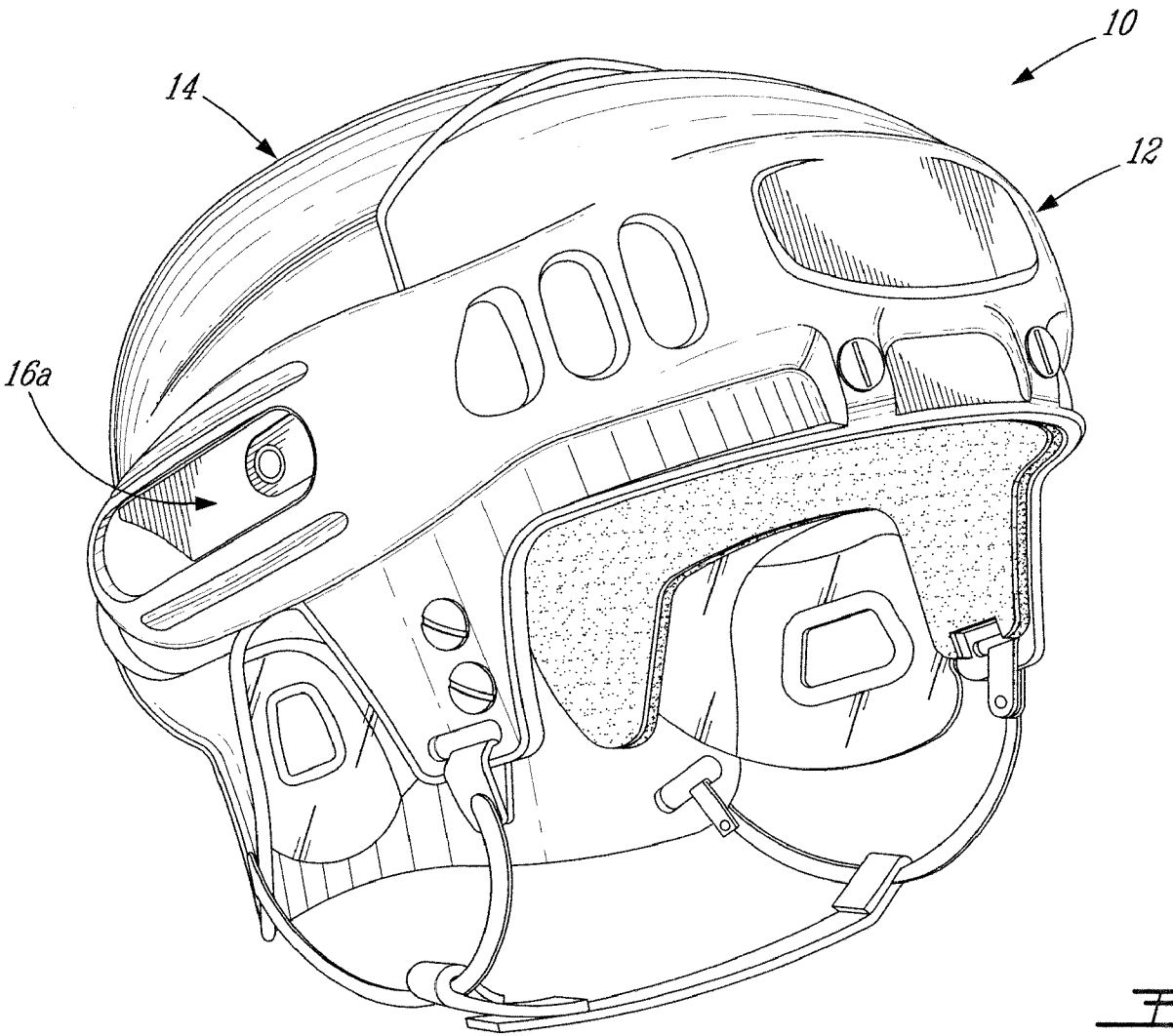
FIG. 1 is a perspective view of a helmet including adjustment mechanisms according to a particular embodiment of the present invention.

Referring to FIG. 1, a helmet 10 according to a particular embodiment of the present invention comprises a front half section 12 and a rear half section 14 cooperating to form a helmet shell. The front and rear half sections 12, 14 are preferably formed of a high strength plastic material having an impact absorbing liner disposed therein. The front and rear half sections 12, 14 are inter-connected through a pair of locking assemblies generally indicated at 16*a,b*, only the right-side one 16*a* being visible in FIG. 1. The locking assemblies 16*a,b* are part of the adjustment mechanisms according to a particular embodiment of the present invention.

Figure 2:
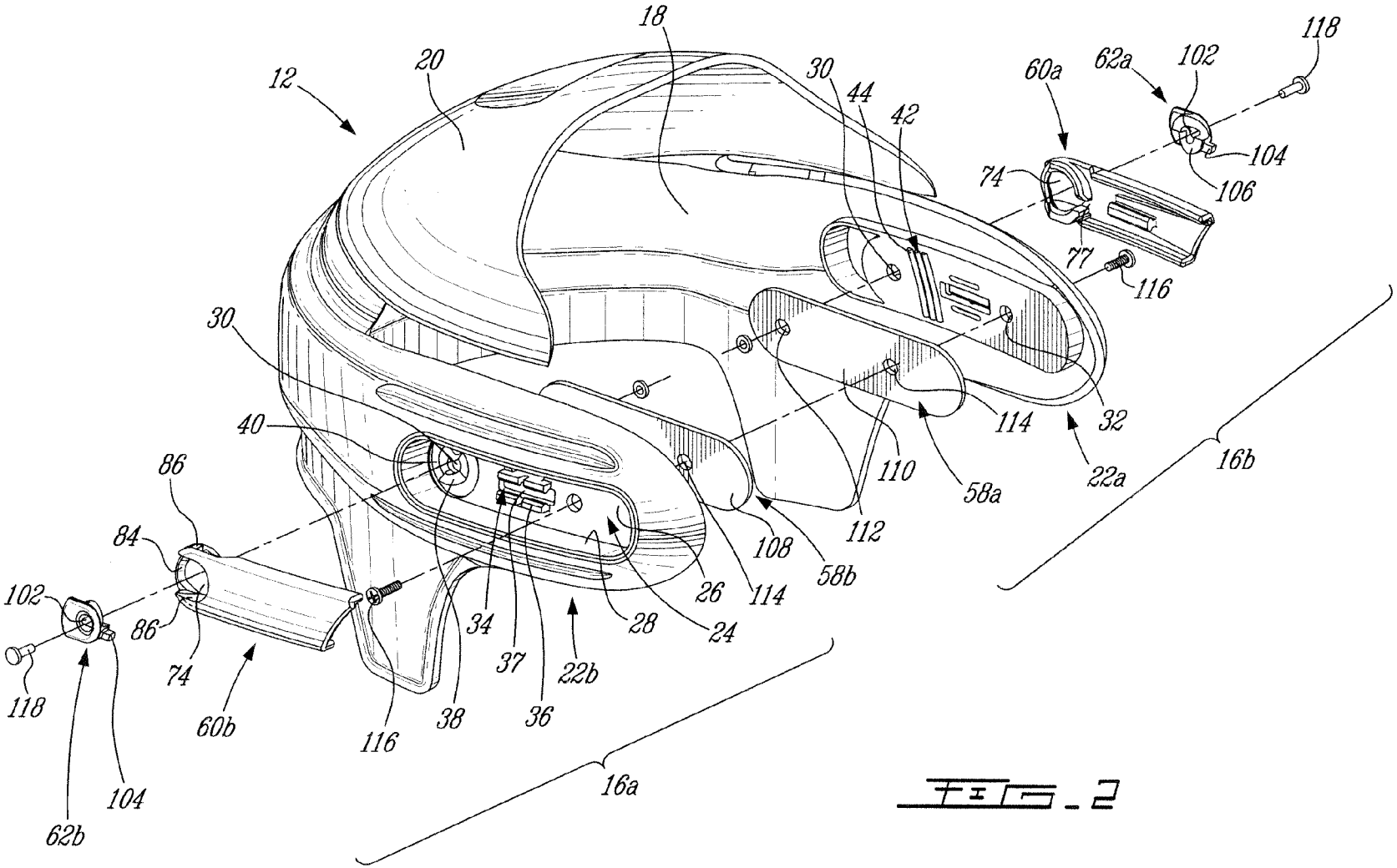
FIG. 2 is a perspective exploded view of locking assembly elements forming part of the adjustment mechanisms of FIG. 1 and of a front half section of the helmet of FIG. 1.

Referring to FIG. 2, the front half section 12 has an inner surface 18 intended to be in contact either directly or indirectly with the head of a user, and an opposed outer surface 20. The front half section 12 also has two opposed side portions 22*a,b*, each including an elongated recess 24 defined in the outer surface 20. The recess 24 is shown as being oblong-shaped and is adapted to receive elements of the corresponding locking assembly 16*a,b*, as will be described further below. The recess 24 is defined by an oblong recessed wall 26 substantially parallel and inwardly offset from the outer surface 20, and connected thereto along its perimeter by a recessed border 28.

The recessed wall 26 includes first and second spaced apart holes 30, 32 defined therethrough configured and designed to be in communication with the inner surface 18. An engagement member 34 projects from the recessed wall 26, shown to be disposed at mid-distance between opposed elongated sections of the recessed border 28 and between the two holes 30, 32. It is understood however, that the engagement member 34 may be disposed anywhere else in the recess 24, including on the recessed border 28. The engagement member 34 is shown to include a clamping member formed by two spaced apart fingers 36, with a slot 37 being defined in the recessed wall 26 therebetween. Also, the engagement member 34 is shown to be completely contained within the recess 24, i.e. it does not extend pass the outer surface 20. As may be understood, variations in the configuration and disposition of the engagement member 34 is possible.

Still referring to FIG. 2, two arcuate first ramping members 38 (also visible in FIGS. 11-12) extend from the recessed wall 26, substantially surrounding the first hole 30. The first ramping members 38 have a ramping profile with respect to the recessed wall 26 along a perimeter of the hole 30, and each have an end defining a somewhat vertical wall terminating at or near the recessed wall 26. As such, an angular free space 40 is defined between each vertical wall of one ramping member 38 and the adjacent ramping member 38. In other words, each ramping member 38 partially circumscribes the hole 30, extending progressively further away from the recessed wall 26 along an angular direction of the hole 30 from one free space 40 to another. As such, the hole 30 is bordered by the ramping members 38 and the recessed wall 26, and by the recessed wall 26 alone in the free spaces 40. Thus, the border of the hole 30 has a configuration similar to one thread of a screw. Alternately, a single one or more than two ramping members 38 can be provided, or the border of the hole 30 can have another adequate type of profile.

Each side portion 22*a,b* also includes, between the two holes 30, 32, a textured engagement region 42 on the inner surface 18 of the front half section 12, the engagement region 42 being defined by a plurality of spaced apart ridges 44. Alternatively the ridges 44 may be in contact with each other.

Figure 5:
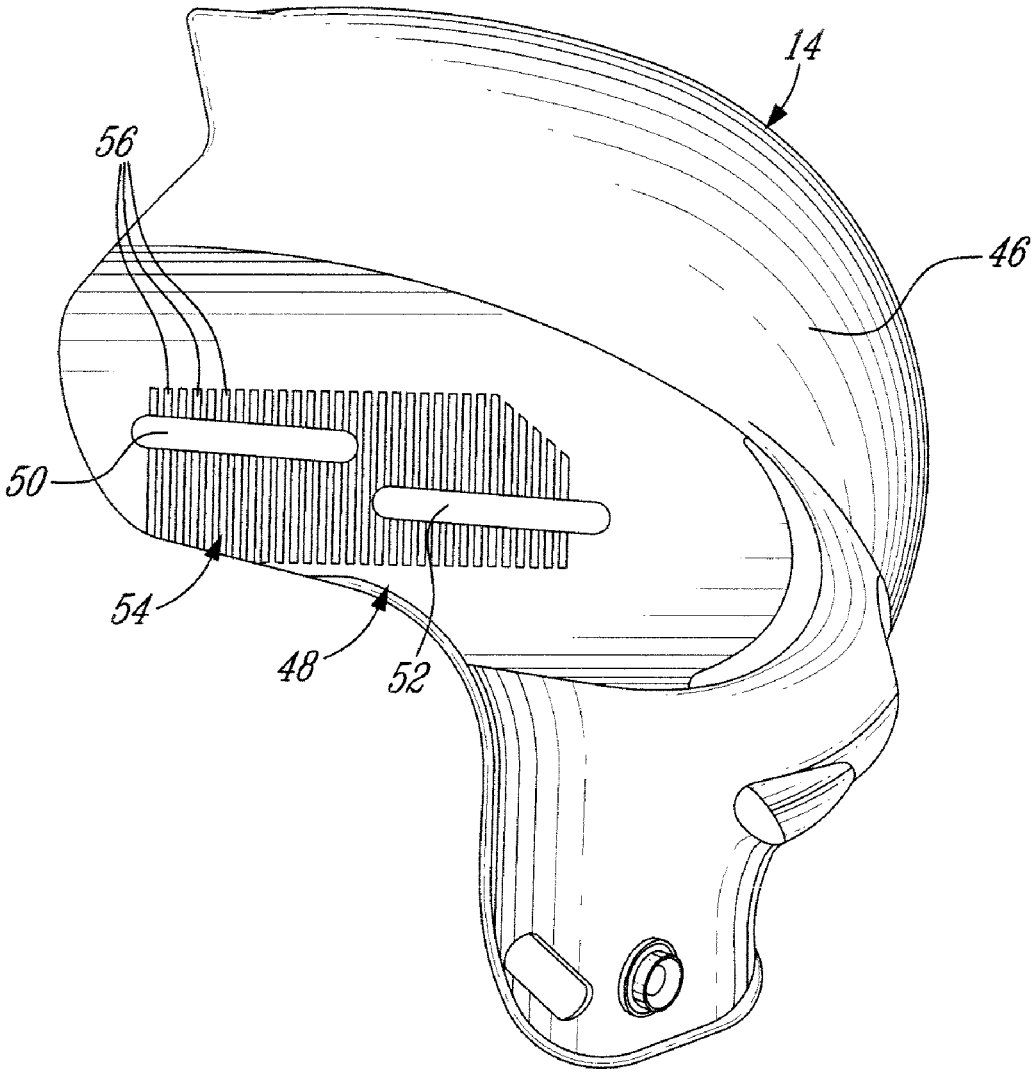
FIG. 5 is a side view of a rear half section of the helmet of FIG. 1.

Referring to FIG. 5, the rear half section 14 has an inner surface (not shown), an outer surface 46, and two side portions 48 (only one of which is shown). Each side portion 48 comprises first and second slots 50, 52 defined therein. In the embodiment shown, the slots 50, 52 are vertically and horizontally spaced apart, although other arrangements are possible. The distance between the first and second slots 50, 52 corresponding to a distance between the first and second holes 30, 32 in the front half section 12, such that each slot 50, 52 can be aligned with a corresponding one of the holes 30, 32. In the embodiment shown, the slots 50, 52 have an oblong shape, although alternate slot configurations can also be used such as, for example, rectangular or elongated polygonal shaped slots. Each side portion 48 also comprises an engagement region 54 defined in the outer surface 46 and shown as surrounding the slots 50, 52, the engagement region 54 being defined by a plurality of spaced apart grooves 56. The grooves 56 are sized and spaced apart such as to be complementary to and engageable with the ridges 44 forming the engagement region 42 of the front half section 12. As will be explained further below, the engagement region 54 of the rear half section 14 will cooperate with the engagement region 42 of the front half section 12 when adjusting the size of the helmet 10.

The helmet front and rear half sections 12, 14 are releasably secured together in a desired adjusted position by the locking assemblies 16*a,b*. Each locking assembly 16*a,b* includes a spring plate 58*a,b*, a lever 60*a,b* and a pivoting element 62*a,b* (see FIG. 2).

Figure 7:
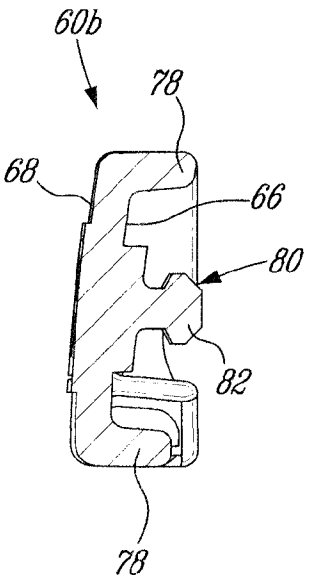
FIG. 7 is a cross-sectional view of the lever taken along lines 7-7 in FIG. 6.
Figure 6:
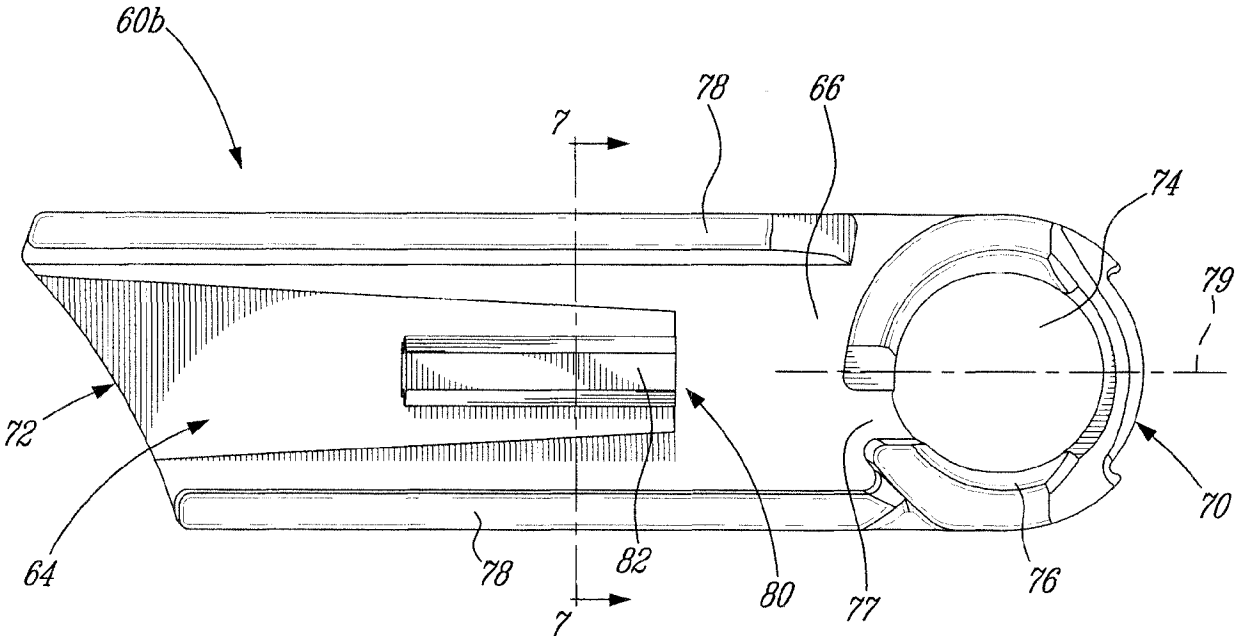
FIG. 6 is a bottom plan view of a lever of the locking assembly of FIG. 2.

Referring to FIGS. 6 and 7, only the left-side lever 60*b* will be described in further detail, the right-side lever 60*a* being a mirror image of the left-side lever 60*b*. The lever 60*b* comprises an elongated body 64 which is sized to be received within the recess 24 of the front half section 12 (shown in FIG. 2). The body 64 has an inner surface 66 and an outer surface 68 and defines first and second opposed ends 70, 72. The first end 70 has a circular profile substantially corresponding with a perimeter of one end of the recess 24, while the second end 72 is shown to be cut to form an oblique, arcuate profile which may facilitate gripping by a user's fingers. The length of lever 60*a,b* may vary and may fill more or less of the recess 24 than shown.

A hole 74 is defined through the lever body 64 in proximity to the first end 70. A hole border 76 extends from the inner surface 66 of the body 64 around the hole 74, the hole border 76 defining the circular profile of the first end 70. In the embodiment shown, the hole border 76 has a slot 77 defined therethrough formed by an interruption in the border 76, exposing a portion of the inner surface 66. The slot 77 extends parallel to and offset from a diameter 79 of the hole 74. Alternate configurations and positions for the slot 77 are also possible. The hole 74 and first end 70 are sized and defined such that, with the hole 74 aligned with the first hole 30 in the recess 24, the first end 70 is adjacent to the recessed border 28 in proximity of the hole 30.

Elongated borders 78 extend from the inner surface 66 of the lever body 64 along the two opposed elongated ends thereof, from the second end 72 to in proximity of the hole border 76. A finger 80 extends from the inner surface 66 of the body 64, preferably at mid-distance between the borders 78. The free end of the finger 80 forms an enlarged head 82 which is sized and located to be received and releasably retained between the fingers 36 of the engagement member 34 of the front half section 12.

Alternately, the finger 80 may be disposed otherwise than as illustrated, and may be shaped and configured differently, for example, with a round or oval head 82. Also, the finger 80 may be replaced by other adequate means to hold the lever 60*a,b* in place within the recess 24. For example, the lever 60*a,b* may be sized and configured such that part of it, for example, the elongated borders 78, frictionally engages the recessed border 28 so as to create a snap fit.

The outer surface 68 of the lever body 64 in the embodiment shown is smooth, for example to be adapted to receive an identification indicia thereon. The outer surface 68 includes an arcuate recessed portion 84 between the hole 74 and the first end 70, as can be seen in FIG. 2 for the left side lever 60*b*. Thus, the outer surface 68 defines a pair of opposed arms 86, tangential to the hole 74 and parallel to the elongated edges of the body 64, which are interconnected by the hole border 76 in the recessed portion 84.

Figure 8:
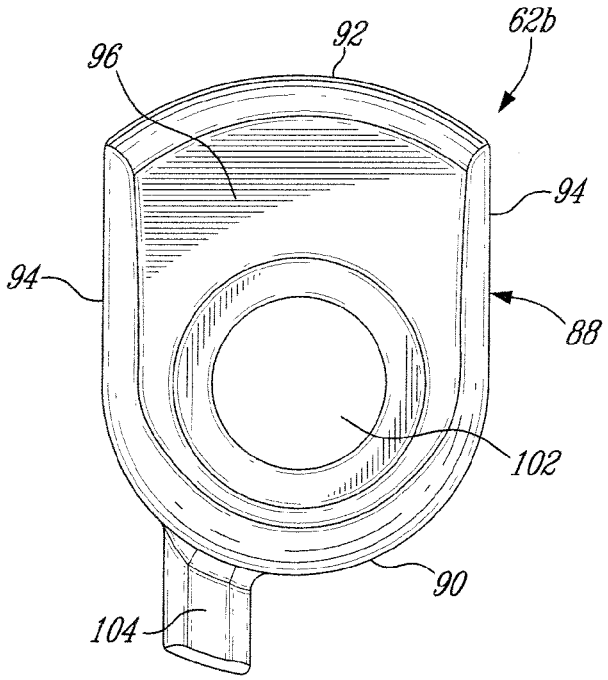
FIG. 8 is a top plan view of a pivoting element of the locking assembly of FIG. 2.
Figure 9:
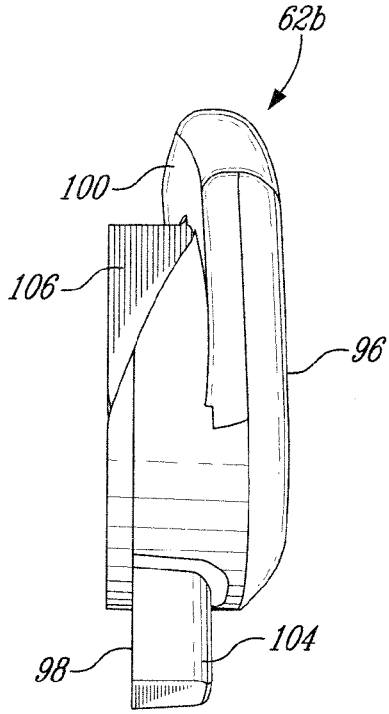
FIG. 9 is a side view of the pivoting element of FIG. 8.

Referring to FIGS. 8 and 9, only the left-side pivoting element 62*b* will be described in further detail, the right-side pivoting element 62*a* being a mirror image of the left-side pivoting element 62*b*. The pivoting element 62*b* has a body 88 having a profile adapted to be received in the hole 74 and in the recessed portion 84 of the respective lever 60*a,b*, i.e. it has a first rounded edge 90 substantially corresponding to half of a perimeter of the hole 74, a second rounded edge 92 substantially corresponding to an outer perimeter of the hole border 76 in the recessed portion 84, and opposed straight edges 94 interconnecting the rounded edges 90, 92 and adapted to abut the arms 86 of the lever 60*a,b*. The body 88 has an outer surface 96 and an inner surface 98, the inner surface 98 forming a shoulder 100 at the second rounded edge 92, such that when the body 88 is inserted into the lever hole 74, the shoulder 100 abuts the hole border 76 in the recessed portion 84, and the outer surface 96 is substantially aligned with the lever outer surface 68.

Figure 11:
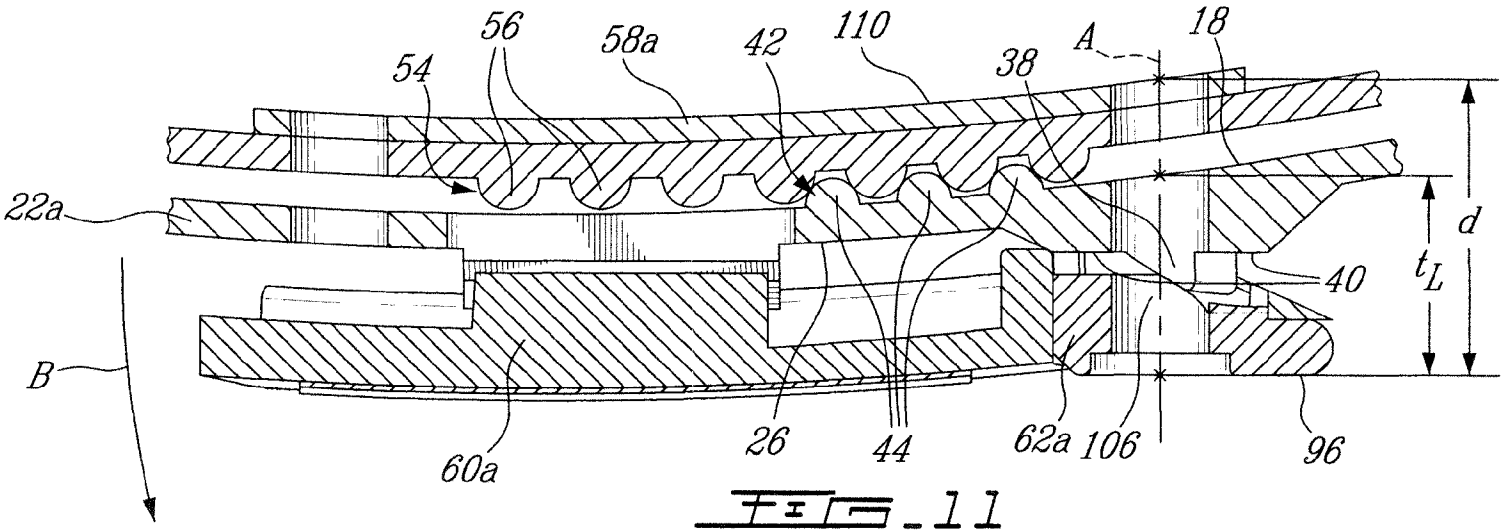
FIG. 11 is a cross-sectional view of the locking assembly in a locked position, taken along 11-11 in FIG. 3.

The relative shape of the pivoting elements' body 88 and of the lever's body 64 around the hole 74 is such as to allow the lever 60*b* to pivot relative to the pivoting element 62*b* along an axis substantially perpendicular to an axis A of the hole 74, as illustrated by arrow B in FIG. 11, thus allowing the lever 60*a,b* to be "lifted" to extend at an angle with respect to a plane defined by the recessed wall 26.

Figure 12:
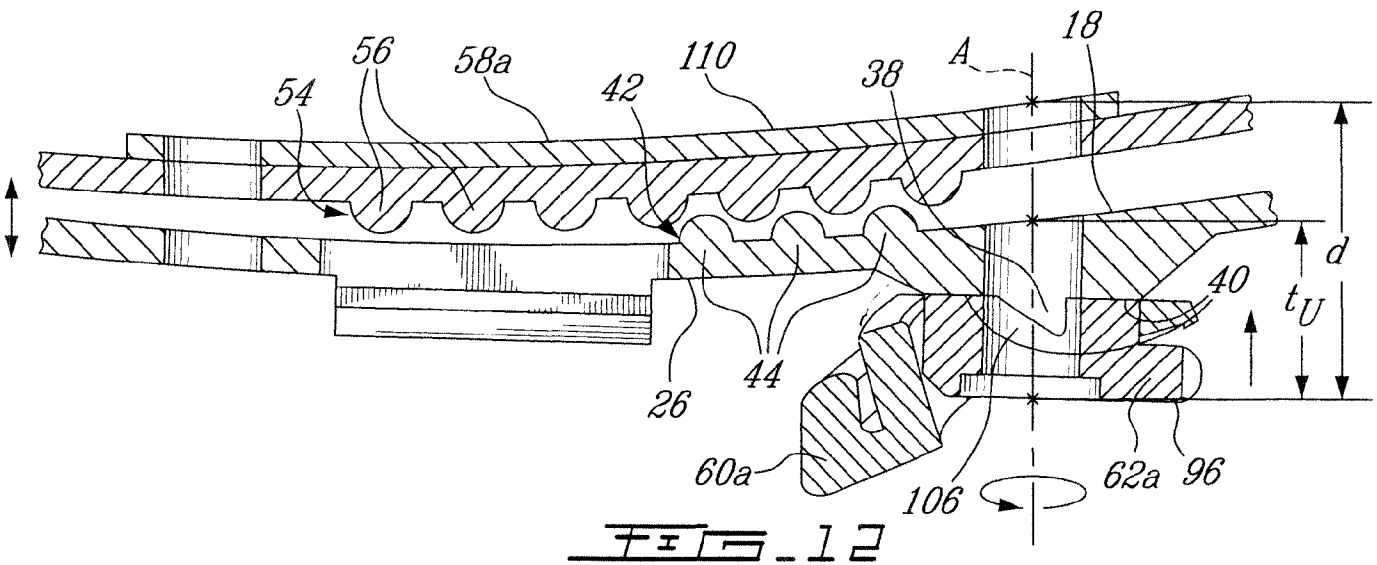
FIG. 12 is a cross-sectional view of the locking assembly of FIG. 11, in an unlocked position.

A hole 102 is defined in the body 88 of the pivoting element 62*b* such as to be concentric with the lever hole 74 when the body 88 is inserted therein. A finger 104 protrudes from the body 88 and is sized and located such as to be received in the slot 77 in the hole border 76 of the lever 60*a,b* when the body 88 is in place in the lever hole 74. The finger 104 and slot 77 engagement ensures that the lever 60*b* and pivoting element 62*b* form a pivoting member integrally pivoting about an axis of the concentric holes 74, 102. The body 88 of the pivoting element 62*b* also includes two arcuate second ramping members 106 (see also FIGS. 11-12) defined in the inner surface 98 around the hole 102. These second ramping members 106 have an opposite profile from the first ramping members 38, and are sized and configured to cooperate therewith, namely so as to be able to abut one another similar to pieces of a puzzle, as shown in FIG. 12. Thus the ramp surfaces of the first ramping members 38 may engage the ramp surfaces of the second ramping members 106 in a sliding motion, in one direction and in the reverse direction.

Figure 10:
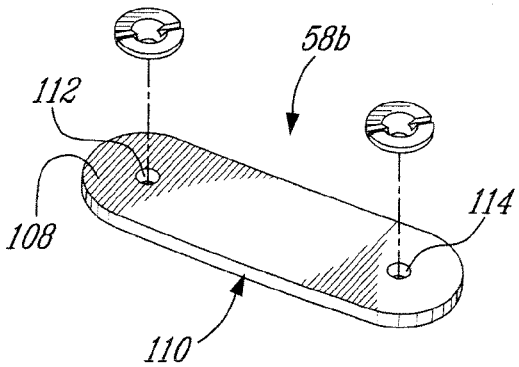
FIG. 10 is a perspective view of a spring plate of the locking assembly of FIG. 2.

Referring to FIG. 10, only the left-side spring plate 58*b* will be described in further detail, the right-side spring plate 58*a* being a mirror image of the left-side spring plate 58*b*. The spring plates 58*a,b* are flexible and may be formed so as to impart both strength and flexibility thereto. In a particular embodiment, the spring plate 58*b* is substantially arcuate and has opposed concave and convex surfaces 108, 110. The spring plate 58*b* also includes first and second holes 112, 114 defined therethrough, a distance between the first and second holes 112, 114 being substantially equal to the distance between the first and second holes 30, 32 in the front half section recess 24.

The front and rear half sections 12, 14 and locking assemblies 16*a,b* are assembled together according to the following. First, the rear half section 14 and the front half section 12 are engaged with one another (see FIG. 1) such that each engagement region 54 on the outer surface 46 of the rear half section 14 (shown in FIG. 5) contacts the respective engagement region 42 on the inner surface 18 of the front half section 12 (shown in FIG. 2), with the first and second holes 30, 32 of the front half section 12 respectively aligned with the first and second slots 50, 52 (shown in FIG. 5) of the rear half section 14.

Referring to FIG. 2 where the rear half section 14 is omitted for improved clarity, a respective one of the spring plates 58*a,b* is placed with the concave surface 108 against the inner surface of the rear half section 14, with the first and second plate holes 112, 114 respectively aligned with the first and second front half section holes 30, 32 through the respective rear half section slot 50, 52 (shown in FIG. 5). A fastener 116 such as for example a screw or a rivet is inserted into the aligned second holes 32, 114 and second slot 52 (shown in FIG. 5) and maintained in place by appropriate means (e.g. a washer in the case the fastener 116 is a rivet).

Each pivoting element 62*a,b* is inserted in the hole 74 of the respective lever 60*a,b*, with the pivoting element's finger 104 inserted in the lever slot 77. The hole 102 of each pivoting element 62*a,b* is aligned with the respective aligned first holes 30, 112 and with the respective first slot 50 (shown in FIG. 5). A second fastener 118, such as for example a screw or a rivet, is inserted into the aligned pivoting element's hole 102, front half section's first hole 30, rear half section's first slot 50 (shown in FIG. 5), and plate's first hole 112, and maintained in place by appropriate means (e.g. a washer in the case the fastener 116 is a rivet). The second fastener 118 thus acts as the pivot of the pivoting element 62*a,b*. The pivoting element 62*a,b* retains the lever 60*a,b* to the front half section 12 and pivots about the second fastener 118. The lever 60*a,b* also pivots about the second fastener 118 integrally with the pivoting element 62*a,b* because of the finger 104 of the pivoting element 52*a,b* received into the lever slot 77.

Figure 3:
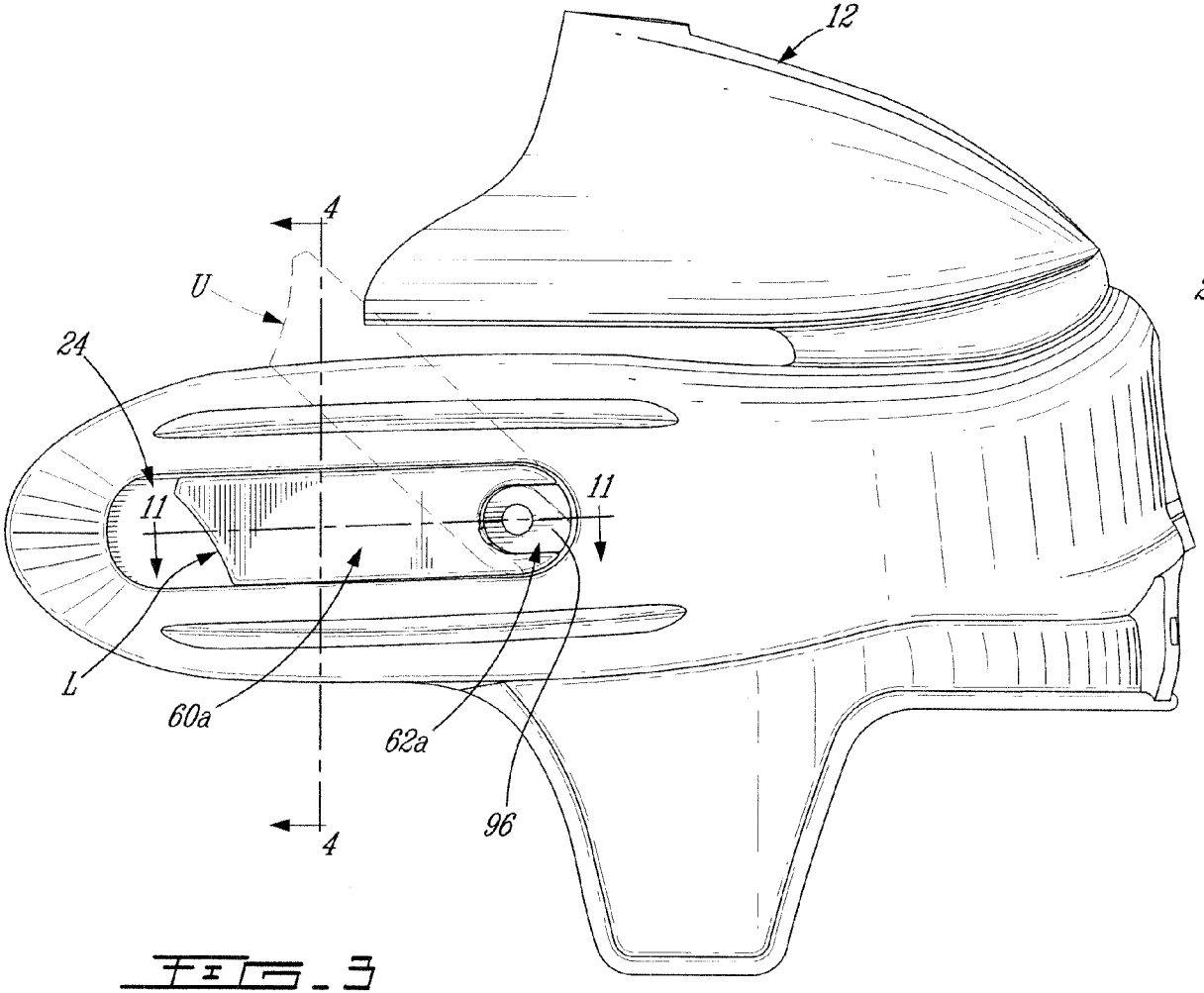
FIG. 3 is a side view of the front half section and of one locking assembly of FIG. 2, showing the locking assembly in a locked position in plain lines and in an unlocked position in broken lines.

Referring to FIG. 3, the pivoting member including the lever 60*a* and pivoting element 62*a* is moveable between an unlocked position U (shown in broken lines) and a locked position L (shown in plain lines). The lever 60*b* and pivoting element 62*b* are similarly moveable. In the unlocked position U, the lever 60*a,b* extends at an angle with respect to the recessed wall 26 such as to extend out of the recess 24. Referring to FIG. 12, the second ramping members 106 are angularly oriented on the respective pivoting element 62*a,b* such that in the unlocked position U, the second ramping members 106 abut the corresponding first ramping members 38 of the front half section 12 with a highest point of each second ramping member 106 located in a respective one of the free spaces 40 between the first ramping members 38. In other words, in the unlocked position U, the ramping members 38, 106 are engaged in one another like puzzle pieces to form a continuous cylindrical surface around the hole 30, thus minimizing a total thickness $t_U$ of the respective pivoting element 62*a,b* and corresponding front section side portion 22*a,b* (i.e. a distance between the outer surface 96 of the pivoting element 62*a,b* and the inner surface 18 of the side portion 22*a,b*).

However, as shown in FIG. 11, when the lever 60*a,b* and pivoting element 62*a,b* are pivoted toward the locked position L, the pivoting element 62*a,b* is moved away from the recessed wall 26 (i.e. moved further away from its position when the lever 60*a,b* is in the unlocked position U) through the interaction of the ramping surfaces of the ramping members 38, 106 which slide on each other during the rotation of the pivoting element 62*a,b*. In other words, when in the locked position L, the ramping members 38, 106 do not fit like puzzle pieces, i.e. a highest point of each second ramping member 106 is located against the respective first ramping member 38 away from the respective free space 40. This causes a relative axial displacement between the pivoting element 62*a,b* and the recessed wall 26, thus increasing the total thickness $t_U$ of the respective pivoting element 62*a,b* and corresponding front section side portion 22*a,b*.

Thus, in use and as seen in FIGS. 3 and 12, the levers 60*a,b* are put in the unlocked position U. In this position, as the total thickness $t_U$ of each pivoting element 62*a,b* and the corresponding side portion 22*a,b* is minimal, the two fasteners 116, 118 maintain a minimal tension on the assembly, allowing a sliding motion between the front and rear half sections 12, 14. Thus, the fasteners 116, 118 slide within the rear half section slots 50, 52 (shown in FIG. 5) while the engagement regions 42, 54 (also shown in FIGS. 2 and 5) slide against each other until the desired fit is obtained. The sliding of the grooves 56 and ridges 44 against each other during sliding of the engagement regions 42, 54 allows the helmet user/wearer to maintain a tactile feel during helmet adjustment. Thus, the end result is an adjustment mechanism that allows for adjustment of the helmet 10 with controllable movements and, in turn, substantial accuracy toward a desired fit. The adjustment can be accomplished while a user is actually wearing the helmet 10 or, if desired, while the helmet 10 is removed from the wearer's head.

Alternately, it is also possible to omit the engagement regions 42, 54 as well as the grooves 56 and ridges 44 from the helmet.

Once the wearer has adjusted the helmet 10 to the correct size, the levers 60*a,b* are rotated into the locked position L shown in FIGS. 3 and 11, rotating therewith the respective pivoting element 62*a,b* through the pivoting element's finger 104 engaged in the slot 77 of the lever 60*a,b*. Through sliding of the ramping surfaces of the ramping members 38, 106, the total thickness $t_L$ of each pivoting element 62*a,b* and the respective side portion 22*a,b* is increased. However, the distance d between the outer surface 96 of each pivoting element 62*a,b* and the convex surface 110 of the corresponding spring plate 58*a,b* (shown in FIG. 2) is kept constant (or substantially constant) by the fastener 118 connecting them together through the front and rear half sections 12, 14. Thus, in the locked position L, each pivoting element 62*a,b* pushes the recessed wall 26 toward the rear half section 14, and the respective spring plate 58*a,b* is deflected and pushes the rear half section 14 toward the front half section 12, and as such the corresponding engagement regions 42, 54, are pressed against each other. This increased pressure prevents the sliding motion of the engagement regions 42, 54 and thus locks the position of the front half section 12 with respect to the rear half section 14.

The helmet half sections 12, 14 are thus secured together by the locked cooperation between the grooves 56 and ridges 44 pressed against each other and/or by the sheer compressive force placed on the two helmet half sections 12, 14 by the interconnected pivoting elements 62*a,b* and spring plates 58*a,b*. In addition, the deflected concave and convex surfaces 108, 110 of the spring plate 58*a,b* adds a biasing force onto the engagement regions 42, 54 to further maintain the engagement.

Figure 4:
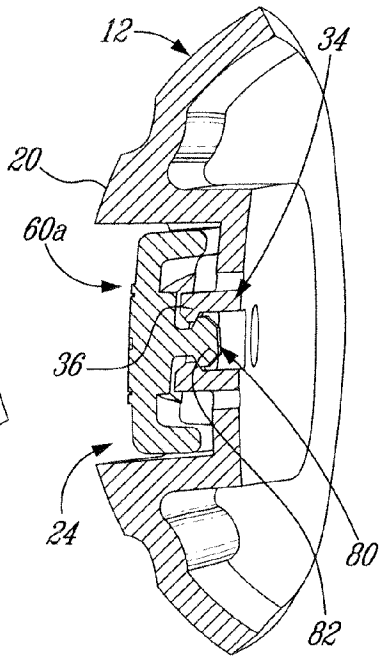
FIG. 4 is a cross-sectional view of part of the front half section and locking assembly taken along line 4-4 in FIG. 3.

As shown in FIG. 4, the lever 60*a* and pivoting element 62*a* (and similarly the lever 60*b* and pivoting element 62*b*) are retained in the locked position by pivoting the lever 60*a* relative to the pivoting element 62*a* about the axis substantially perpendicular to the fastener 118, from an angled position with respect to the recessed wall 26 to a position parallel, or substantially parallel, to the recessed wall 26, and as such pressing the lever 60*a* against the engagement member 34 to engage the enlarged head 82 of the lever finger 80 therebetween. In the locked position, the levers 60*a,b* are completely contained in the respective recess 24, and in a particular embodiment, disposed below the level of the outer surface 20 of the front half section 12, and as such shielded from accidental or unwanted contact. In addition, if accidental contact does occur despite the shielding, the levers 60*a,b* are further prevented from rotating to the unlocked position by the engaged front portion and lever fingers 36, 80 which retain the levers 60*a,b* in place.

The embodiments of the invention described above are intended to be exemplary. Those skilled in the art will therefore appreciate that the foregoing description is illustrative only, and that various alternatives and modifications can be devised without departing from the spirit of the present invention. For example, the present device could be use in numerous other types of helmets or protection gear, and should not be viewed as limited to hockey or even to sports. Accordingly, the present invention is intended to embrace all such alternatives, modifications and variances which fall within the scope of the appended claims.

We claim:

1. A helmet comprising:

a helmet shell including cooperating first and second sections in slidable engagement with one another, the first section including at least one engagement region on an inner surface thereof having a profile complementary to an engagement region on an outer surface of the second section and in slidable engagement therewith;

at least one locking assembly interconnecting the first and second sections, the locking assembly including a pivoting member pivotable between a locked position and an unlocked position, the pivoting member in the locked position reducing a distance between the engagement regions by pressing the engagement regions against one another such as to prevent a relative sliding motion therebetween, the pivoting member in the unlocked position allowing an increase in the distance between the engagement regions to allow the relative sliding motion; and at least one engagement member connected to the first shell section and removably engaging the pivoting member in the locked position to prevent accidental movement of the pivoting member toward the unlocked position.

2. The helmet according to claim 1, wherein the engagement member includes two spaced apart first fingers removably retaining therebetween a second finger extending from the pivoting member.

3. The helmet according to claim 1, wherein the engagement member is located in a recess defined in the first section, and the pivoting member is located in the recess in the locked position.

4. The helmet according to claim 3, wherein the pivoting member is completely contained in the recess in the locked position such as to be shielded from accidental contact.

5. The helmet according to claim 1, wherein the second section is partially located inwardly of the first section, the pivoting member is adjacent an outer surface of the first section, and the locking assembly includes a plate located adjacent an inner surface of the second section and connected to the pivoting member through the first and second sections by a pivot, the pivoting member being pivotable about the pivot.

6. The helmet according to claim 5, wherein the pivoting member includes first ramping members complementary to second ramping members extending from the first section, the first and second ramping members cooperating such that a distance between an outer surface of the pivoting member and an inner surface of the first section is increased when the pivoting member is moved from the unlocked position to the locked position, a distance between an inner surface of the plate and the outer surface of the pivoting member remaining at least substantially constant.

7. The helmet according to claim 1, wherein the pivoting member includes a pivoting element pivotable about a pivot extending through the first and second sections, and a lever connected to the pivoting element such as to pivot integrally therewith about the pivot, the lever also being pivotable relative to the pivoting element about an axis substantially perpendicular to the pivot.

8. The helmet according to claim 7, wherein the engagement member is located in a recess defined in the first section, and wherein the lever is located in the recess in the locked position and at least partially out of the recess in the unlocked position, the lever engaging the engagement member in the locked position.

9. A sports helmet comprising:

a helmet shell including first and second cooperating sections, the second section being partially received inwardly of the first section;

at least one locking assembly interconnecting the first and second sections in slidable engagement with one another and including a pivoting member adjacent an outer surface of the first section, the pivoting member being pivotable between an unlocked position and a locked position about a pivot extending through the first and second sections, the locking assembly with the pivoting member in the unlocked position allowing a relative sliding motion between the first and second sections, and in the locked position pressing the first and second sections against one another such as to prevent the sliding motion; and an engagement member extending from the first section and releasably retaining the pivoting member in the locked position.

10. The helmet according to claim 9, wherein the engagement member includes two spaced apart first fingers removably retaining a second finger extending from the pivoting member therebetween.

11. The helmet according to claim 9, wherein the outer surface of the first section includes a recess defined therein, the engagement member being located in the recess, and the pivoting member being contained in the recess in the locked position.

12. The helmet according to claim 9, wherein the first section includes at least one engagement region having a profile complementary to an engagement region of the second section and in slidable engagement therewith, the engagement regions being pressed against one another by the pivoting member in the locked position.

13. The helmet according to claim 9, wherein the pivoting member includes at least one first ramping member complementary to at least one second ramping member extending from the first section, the first and second ramping members cooperating such that a distance between an outer surface of the pivoting member and an inner surface of the first section is increased when the pivoting member is moved from the unlocked position to the locked position.

14. The helmet according to claim 13, wherein the first section has a hole defined therethrough and the second section has a slot defined therethrough, the pivot passing through the hole and the slot, and wherein the second ramping members extend from the first section around the hole.

15. The helmet according to claim 9, wherein the pivoting member includes a pivoting element pivotable about the pivot and a lever connected to the pivoting element such as to pivot integrally therewith about the pivot, and the lever is pivotable relative to the pivoting element about an axis substantially perpendicular to the pivot.

16. A sports helmet comprising:

a first helmet shell section having at least one first hole defined therein and at least one ramping member extending from the first section around the first hole;

a second helmet shell section cooperating with the first section to define a helmet shell, the second section having a portion located inwardly of the first section and having a slot defined therein in alignment with the first hole;

a spring plate located inwardly of the portion of the second helmet shell;

a pivot extending from the spring plate and passing through the slot and the first hole; and a pivoting member adjacent an outer surface of the first section and having a second hole defined therethrough, the pivot being retained in the second hole such that the pivoting member is pivotable about the pivot, the pivoting member including at least one ramping member extending toward the first section around the second hole and complementary to the ramping member of the first shell section, the pivoting member pivoting from an unlocked position, where the ramping members engage one another to define a minimal distance between an outer surface of the pivoting member and an inner surface of the first section, and a locked position, where the ramping members engage one another to define a maximal distance between the outer surface of the pivoting member and the inner surface of the first section;

the minimal distance providing for a loose connection between the first and second shell sections allowing a relative sliding motion therebetween, and the maximal distance providing for a tight connection between the first and second sections preventing the relative sliding motion.

17. The helmet according to claim 16, wherein the first section includes a recess defined therein, the first hole being located in the recess, and the pivoting member is contained in the recess when in the locked position.

18. The helmet according to claim 16, wherein the first section includes an engagement member protruding therefrom, the engagement member releasable retaining the pivoting member in the locked position.

19. The helmet according to claim 16, wherein the pivoting member includes a pivoting element pivotally connected to the pivot and a lever connected to the pivoting element such as to pivot about the pivot integrally therewith, the lever being pivotable relative to the pivoting element about an axis substantially perpendicular to the pivot.

* * * * *

UNITED STATES PATENT AND TRADEMARK OFFICE

CERTIFICATE OF CORRECTION

PATENT NO. : 7,870,618 B2
APPLICATION NO. : 11/529358
DATED : January 18, 2011
INVENTOR(S) : Christian Pilon et al.

It is certified that error appears in the above-identified patent and that said Letters Patent is hereby corrected as shown below:

In claim 18, third line, the word “releasable” should read “releasably”.

Signed and Sealed this
Nineteenth Day of July, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,870,618 B2
APPLICATION NO. : 11/529358
DATED : January 18, 2011
INVENTOR(S) : Christian Pilon et al.

It is certified that error appears in the above-identified patent and that said Letters Patent is hereby corrected as shown below:

Column 10, line 57 (Claim 18, line 3) the word “releasable” should read “releasably”.

This certificate supersedes the Certificate of Correction issued July 19, 2011.

Signed and Sealed this
Sixteenth Day of August, 2011

David J. Kappos

David J. Kappos
*Director of the United States Patent and Trademark Office*